US007687022B2

(12) United States Patent
Nelböck et al.

(10) Patent No.: US 7,687,022 B2
(45) Date of Patent: Mar. 30, 2010

(54) METHOD FOR MANUFACTURING A SYNCHRONIZING RING

(75) Inventors: Günter Nelböck, Seewalchen (AT); Karl Ammer, Vorchdorf (AT)

(73) Assignee: Miba Sinter Austria GmbH, Laakirchen (AT)

( * ) Notice: Subject to any disclaimer, the term of this patent is extended or adjusted under 35 U.S.C. 154(b) by 793 days.

(21) Appl. No.: 11/194,240

(22) Filed: Aug. 1, 2005

(65) Prior Publication Data

US 2007/0025871 A1 Feb. 1, 2007

(51) Int. Cl.
*B22F 7/00* (2006.01)

(52) U.S. Cl. ..... 419/8; 419/38; 75/228

(58) Field of Classification Search ..... 419/8, 419/66, 38; 75/243, 228; 428/212; 427/350
See application file for complete search history.

(56) References Cited

U.S. PATENT DOCUMENTS 4,943,321 A * 7/1990 Akutsu ..... 75/243
5,585,166 A * 12/1996 Kearsey ..... 428/212
6,811,820 B2 * 11/2004 Locker et al. ..... 427/350

* cited by examiner

*Primary Examiner*—George Wyszomierski
*Assistant Examiner*—Weiping Zhu
(74) *Attorney, Agent, or Firm*—Collard & Roe, P.C.

(57) ABSTRACT

To manufacture a synchronizing ring of a synchronizing device for a variable-ratio gear transmission, this synchronizing ring having a ring body having locking teeth on an outer circumference and a friction lining made of a carbon non-woven material bonded to a duroplastic resin on the conical inner circumference, the ring body is compressed from a sintering powder and sintered before the sintered ring body is axially compressed in a die at least in the region of the conical inner circumference. The friction lining is then glued onto the conical inner circumference of the ring body and secured in a mold under pressure while supplying heat.

3 Claims, 1 Drawing Sheet

METHOD FOR MANUFACTURING A SYNCHRONIZING RING

FIELD OF THE INVENTION

The present invention relates to a method for manufacturing a synchronizing ring of a synchronizing device for variable-ratio gear transmission, this synchronizing ring having a ring body having locking teeth on the outer circumference and a friction lining made of a carbon nonwoven material bonded to a duroplastic resin on the conical inner circumference.

DESCRIPTION OF THE PRIOR ART

In variable-ratio gear transmissions having a hub seated on a shaft so that they rotate together and a ratchet wheel mounted so it is freely rotatable on the shaft, providing a synchronizing device having a cone clutch between the hub and the ratchet wheel, which has a double cone ring, causing the ratchet wheel to also rotate, which is clamped with a friction lock between an inner friction ring and a synchronizing ring that is axially adjustable in relation to this friction ring by the sliding sleeve, is known. If the sliding sleeve is displaced on the hub to engage the clutch, through the axial slaving of the synchronizing ring, the double cone ring, and therefore also the ratchet wheel connected to the double cone ring so that they rotate together, is frictionally accelerated to the peripheral velocity of the hub between the inner friction ring and the outer synchronizing ring, which allows the subsequent, unobstructed clutch engagement between the sliding sleeve and the claw collar of the ratchet wheel. Locking teeth, which are positioned on the synchronizing ring and work together with the claws of the sliding sleeve, prevent the sliding sleeve from being able to perform the axial clutch movement during the synchronizing in this case.

In order to be able to advantageously meet the requirements which are placed on such a synchronizing ring, in addition to sufficient carrying capacity, high precision, in particular in regard to roundness and true running, are required. One tries to meet these high precision requirements by machining the conical inner circumference of the synchronizing ring before applying the friction lining, which is made of a carbon nonwoven material bonded to duroplastic resin, for example, which is, however, connected to a corresponding labor outlay.

SUMMARY OF THE INVENTION

The present invention is thus based on the object of implementing a method for manufacturing a synchronizing ring of a synchronizing device for a variable-ratio gear transmission of the type described at the beginning in such a way that the synchronizing ring may be manufactured having the required precision using a comparatively low manufacturing outlay.

The present invention achieves the stated object through the following method steps:

- compressing the ring body from a sintering powder and sintering the compressed ring body,
- axial compressing of the sintered ring body in a die at least in the region of the conical inner circumference,
- gluing the friction lining to the conical inner circumference before the duroplastic resin cures,
- compacting and curing the friction lining in a mold under pressure while supplying heat.

Through the axial compression of the sintered ring body in a die at least in the region of the conical inner circumference, the sintering material is not only compacted, but rather also radially displaced, so that the sintering material is compressed against the outer cone of the die corresponding to the conical inner circumference of the ring body. Using this measure, the true running properties and the precision in regard to the roundness of a synchronizing ring may be improved, however, the required low manufacturing tolerances may only be ensured if the friction lining, which is glued onto the conical inner circumference of the ring body prepared in this way, is cured in a mold under pressure while supplying heat. Through the compacting of the friction lining connected therewith, existing tolerance deviations are compensated for, so that through the combination of axial upsetting of the sintered ring body in the region of the conical inner circumference, and radial displacement of the sintering material against a shaping outer cone of the die connected therewith, with compaction in a mold of the friction lining glued onto the inner circumference of the ring body prepared in this way may consideration be taken of high precision requirements without having to provide machining of the ring body in the region of the conical inner circumference. After the curing of the duroplastic resin of the friction lining, no further machining of the synchronizing ring is necessary.

In order to achieve good true running precision and a strength for the ring body corresponding to the occurring loads, the sintered ring body may be upset in the die by at least 5% of its axial length in the region of the conical inner circumference. Especially good conditions results if the ring body is upset by at least 10% of its axial length.

BRIEF DESCRIPTION OF THE DRAWING

The method according to the present invention will be described in greater detail on the basis of the drawing

DESCRIPTION OF THE PREFERRED EMBODIMENT

Figure 1:
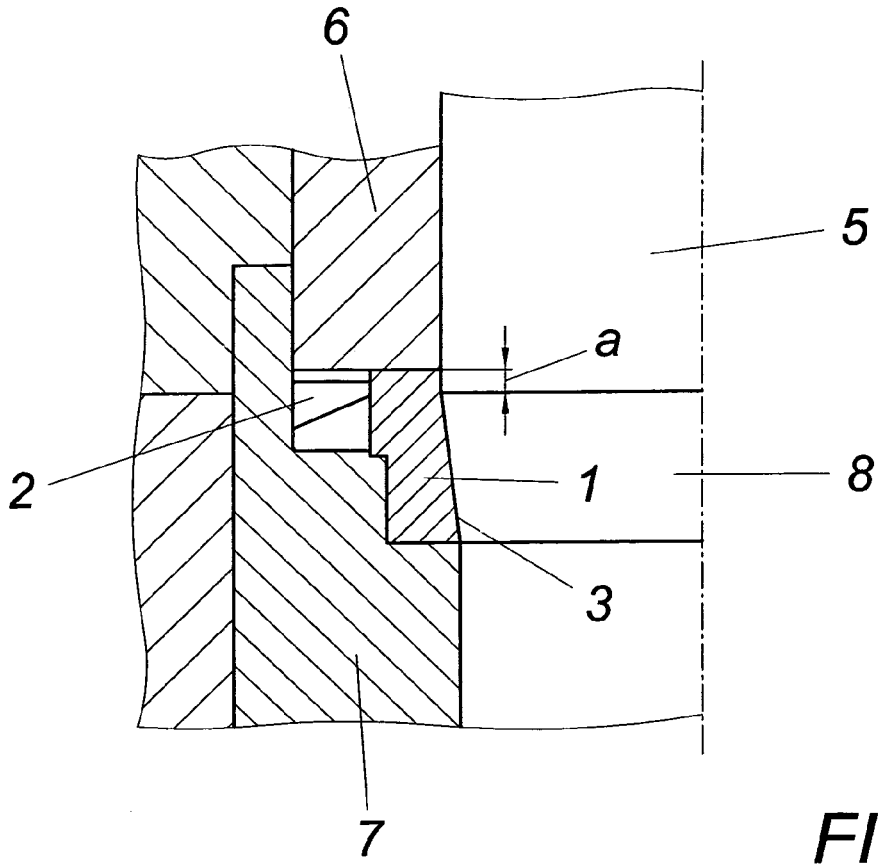
FIG. 1 shows a die for axially compressing the sintered ring body of the synchronizing ring in a simplified axial section and FIG. 2 shows a mold for compacting and curing the friction lining glued to the ring body in a schematic axial section.

The synchronizing ring to be manufactured has a ring body 1 manufactured through powder metallurgy, which has locking teeth 2 on its outer circumference. The ring body 1 is provided with a friction lining 4 on the conical inner circumference 3, which has a nonwoven material made of carbon fibers that is bonded with the aid of a duroplastic resin. The ring body 1 is compressed from a diffusion-alloyed sintering powder having 0.6 weight-percent carbon, 1.5 weight-percent copper, 4.0 weight-percent nickel, and 0.5 weight-percent molybdenum, with the remainder iron, for example, and subsequently sintered in a typical way. Before the friction lining 4 is applied, the sintered ring body 1 is laid in a die as shown in FIG. 1, whose top, which is guided on a mandrel 5, is identified by 6, and whose bottom is identified by 7. The mandrel 5 forms an outer cone 8 corresponding to the conical inner circumference 3. Therefore, if the top 6 of the die receiving the ring body 1 is compressed against the bottom 7, the ring body 1 is upset in the axial direction with compaction of the sintering material at least in the region of the conical inner circumference 3, specifically by the dimension a, which corresponds to 12 and 15% of axial height of the ring body 1, for example. Because of this axial upsetting, a radial displacement of the sintering material results, with the effect that the sintering material is compressed against the outer cone 8 of the mandrel 5 so it is compacted.

Figure 2:
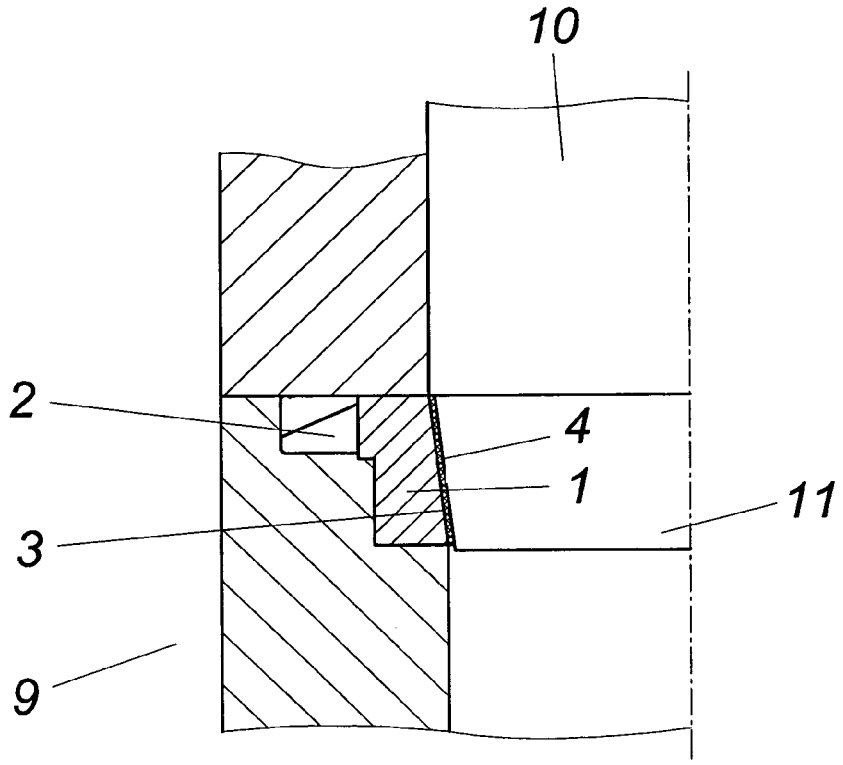

After this compacting mold compression of the sintered ring body 1, the friction lining is glued onto the conical inner-circumference 3 of the ring body 1 and introduced into a mold 9 as shown in FIG. 2, which has a stamp 10 having an outer cone 11 corresponding to the conical inner circumference 3. With the aid of the stamp 10, the friction lining 4 of the ring body 1 laid in the mold 9 may be compacted by a predefined dimension, which is a function of the stroke of the stamp 10 and may be set via this stroke. Since the form 9 is heated in way known per se, the duroplastic resin of the friction lining 4 cures as pressure is applied by the stamp 10. After curing, the synchronizing ring, which comprises the ring body 1 having the friction lining 4, may be removed from the mold 9. A synchronizing ring manufactured in this way fulfills not only high requirements in regard to the carrying capacity, but rather also in regard to roundness and true running.

What is claimed is:

1. A method for manufacturing a synchronizing ring of a synchronizing device for a variable-ratio gear transmission, said synchronizing ring comprising a ring body having a conical inner circumference and locking teeth on an outer circumference and a friction lining made of a non-woven carbon material bonded with a duroplastic resin on the conical inner circumference, comprising the following steps:

compressing a sintering powder into the ring body and sintering the compressed ring body, axially compressing of the sintered ring body in a die at least in the region of the conical inner circumference, gluing the friction lining to the conical inner circumference before the duroplastic is cured, and compacting the friction lining in a mold while curing the duroplastic resin under pressure while supplying heat.

2. The method according to claim 1, wherein the sintered ring body is compressed in the die in the region of the conical inner circumference by at least 5% of its axial length.

3. The method according to claim 2, wherein the sintered ring body is compressed in the die in the region of the conical inner circumference by at least 10% of its axial length.

* * * * *